United States Patent [19]

De Kok

[11] Patent Number: 4,993,226

[45] Date of Patent: Feb. 19, 1991

[54] MULTI-PISTON AIR-OIL PRESSURE INTENSIFIER WITH AUTOMATICALLY VARIABLE WORKING STROKE LENGTH

[76] Inventor: John De Kok, 68 Glebe Crescent, Brampton, Ontario, Canada, L7L 4X8

[21] Appl. No.: 440,357

[22] Filed: Nov. 20, 1989

[51] Int. Cl.[5] ..... F15B 3/00; F04B 3/00

[52] U.S. Cl. ..... 60/547.1; 60/563; 60/576

[58] Field of Search ..... 60/547.1, 560, 574, 60/576, 578, 579, 583, 593

[56] References Cited

U.S. PATENT DOCUMENTS 2,603,067 7/1952 Nissim ..... 60/547.1

FOREIGN PATENT DOCUMENTS 929959 7/1947 France ..... 60/574

*Primary Examiner*—Edward K. Look
*Assistant Examiner*—George Kapsalas
*Attorney, Agent, or Firm*—C. E. Van Steinburg

[57] ABSTRACT

A pressure intensifier comprising a housing incorporating a first floating piston-cylinder unit with means to supply a primary pressure fluid medium to one side of the piston to apply pressure to a fluid medium in contact with the other side of the first piston, a second floating piston unit provided with a fluid medium communication port therethrough, there being direct communication between the medium contacting the other side of the first floating piston with one side of the second floating piston and through the port thereof to a fluid medium pressure power take-off chamber, the port of the second floating piston being closeable by means of a valve comprising two active parts, one part of which is incorporated in the second floating piston and the other part of which is provided with limited movement with respect thereto, there being means to apply primary fluid pressure to the other side of the said second floating piston to maintain the communication port open, the other part of the valve being constituted by a further ported piston the port of which is closeable by the said valve arrangement to allow the further ported piston to act as a high pressure creating piston on the fluid medium in the power take-off chamber.

8 Claims, 4 Drawing Sheets

MULTI-PISTON AIR-OIL PRESSURE INTENSIFIER WITH AUTOMATICALLY VARIABLE WORKING STROKE LENGTH

BACKGROUND OF THE INVENTION

1. Field of the Invention

This invention relates to air powered pressure intensifier cylinders of the type which provides an operating ram pressure applicator initially with a relatively low hydraulic oil operating pressure and, subsequently with a second higher and final operating pressure, the first lower pressure being utilized to advance a ram to which a tool is secured, for instance a punch, to contact a workpiece and the second higher pressure being used to power the ram to perform the actual work on the workpiece, which work may be the piercing of the workpiece by the punch.

2. Description of the prior Art

Pressure intensifier cylinders providing two distinct pressure steps are known from U.S. Pat. No. 4,271,671-G. G. F. Smeets—issued June 9, 1981 wherein a two step pressure intensifier system is described.

In the arrangement, according to the patent, a first piston, moved by primary air pressure, continues to move, in the working stroke direction, after the ram has been moved, initially, to contact a workpiece, by the provision of a pressure bleed past a second piston directly mechanically activated by the first piston and applying pressure to the oil medium operable on the ram piston per se. At a predetermined position the working stroke direction the pressure bleed is closed off and a stepped up pressure, produced by a third piston, also machanically activated by the first piston, is applied to the oil medium to power the ram piston to perform the final work function.

A disadvantage of the Smeets cylinder, described above, is the fact that the stepped up pressure is applied at a fixed point in the working stroke rather than at a point which may be varied. A further disadvantage of the Smeets cylinder is that the time of a working cycle is fixed and can only be changed by mechanically changing the parameters of the components of the pressure intensifier system.

A further U.S. Pat. No. 4,300,351—A. Grullmeier—issued November 17, 1981 discloses a pressure intensifying cylinder in which a first air powered piston applies spring pressure to a floatig piston, which floating piston is in direct contact with an oil medium by virtue of which pressure is applied to a ram operating piston-cylinder arrangement. The initial portion of the stroke is at a low pressure, applied through the spring, which increases with the distance travelled by the first air powered piston. At a predetermined point in the working stroke direction a third piston, directly operated by the first piston, becomes active to provide a stepped up oil pressure to the ram operating piston whereby the final work function, such as workpiece punching, is performed.

SUMMARY OF THE INVENTION

It is a prime object of the present invention to provide an air to oil pressure intensifier cylinder in which the length of the initial portion of the working stroke is automatically variable dependent on the thickness of a workpiece.

It is a further object of the invention to provide an air to oil pressure intensifier cylinder which will allow a choice between a controlled cycle time and an automatically timed cycle of operation.

It is a still further object of the invention to provide an air to oil pressure intensifier cylinder which is simple and economical to construct, utilizing a minimum number of part and springs.

Other objects and advantages of the invention will become apparent in the detailed description of the invention provided below.

BRIEF DESCRIPTION OF THE DRAWINGS

For a full understanding of the present invention reference will be made to the figures of the drawings in which.

DETAILED DESCRIPTION OF THE INVENTION

Figure 1:
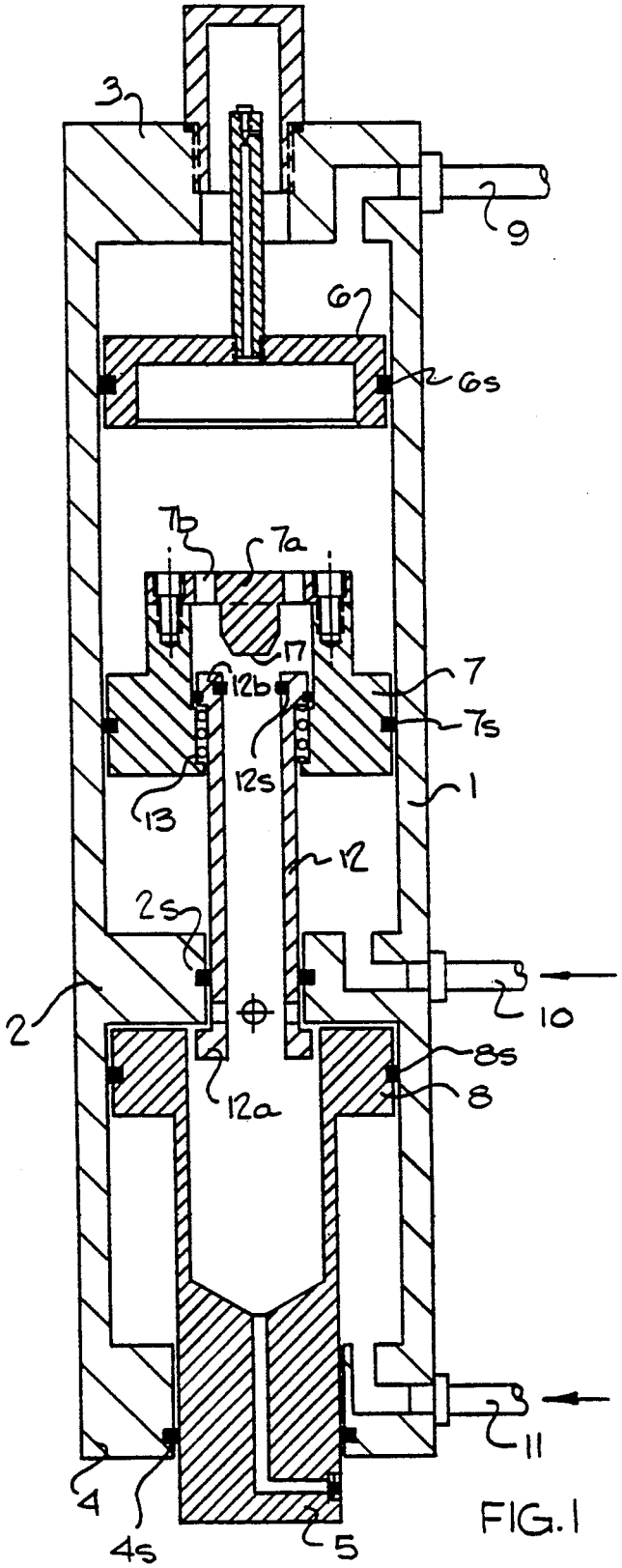
FIG. 1 shows a detailed cross-section of the cylinder, according to the invention, wherein the parts thereof are shown in the position of rest or at the start point of a working cycle which, of course, will correspond to the end point of a working cycle as well.

Referring now to the figures of the drawing, FIG. 1 shows a cross-sectional view of the cylinder, according to the present invention, at the start point of the working stroke thereof. The cylinder comprises a hollow, main cylindrical body housing 1 provided with a centrally apertured partition 2 and three primary pressure ports 9, 10 and 11 to which air pressure can be applied by valve means not shown, which valves can be mechanically or electrically controlled to apply or release air pressure at these ports.

In the upper portion of the cylinder housing there is provided a first floating piston 6, fitted with one or more pressure seals 6*s*. Piston 6 is free to move in the axial direction of the cylinder between the positions shown in FIG. 1 and FIG. 3, for instance. A second floating piston 7, also located in the upper portion of the housing 1, is free to move between a limited upper position and partition 2. The particular construction of piston 7 will be described subsequently in greater detail with reference to FIGS. 3 and 4.

A ram piston 8, provided with pressure seal 8*s*, is incorporated in the lower portion of the housing below partition 2. Piston 8 is provided with an operable ram portion 5, in the form of a cylindrical rod, which extends externally of the housing through an aperture in the lower wall 4 of the housing. The aperture is provided with sealing rings 4*s*. Piston 8 and ram 5 are hollowed out cylindrically and axially thereof to provide accommodation for a hollow cylindrical shaft member 12 to move downward thereinto. Cylinder shaft 12 is provided with end flanges 12*a* and 12*b* wherein flange 12*b* retains the upper end of member 12 within the lower part of piston 7 with freedom to move between the limiting positions thereof shown in FIGS. 1 and 3 while lower flange 12*a* prevents removal of the member 12 upward from the aperture in partition 2. Appropriate seals for member 12, 12*s* in the upper flange of member 12 and seal 2*s* in partition 2 are provided. The interior space of the housing between floating pistons 6 and 7 and the interior spaces of hollow shaft 12 and ram 5 are filled with an oil medium, i.e. hydraulic oil.

By means of ports 9, 10, 11 primary fluid (air) pressure can be applied to the upper side of piston 6 and the lower sides of pistons 7 and 8 respectively.

Figure 4:
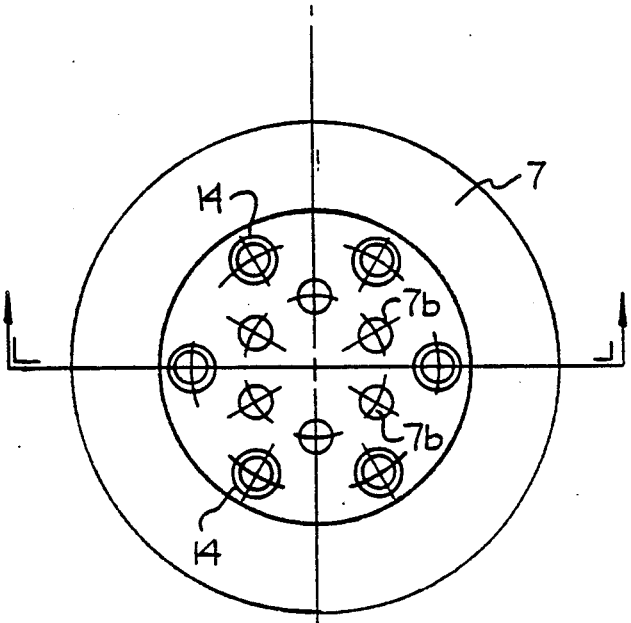
FIG. 4 shows an enlarged detail portion of a piston with a ported valve system which is operative to switch the cylinder per se between the low and high pressure operations of the working cycle of the cylinder.
Figure 5:
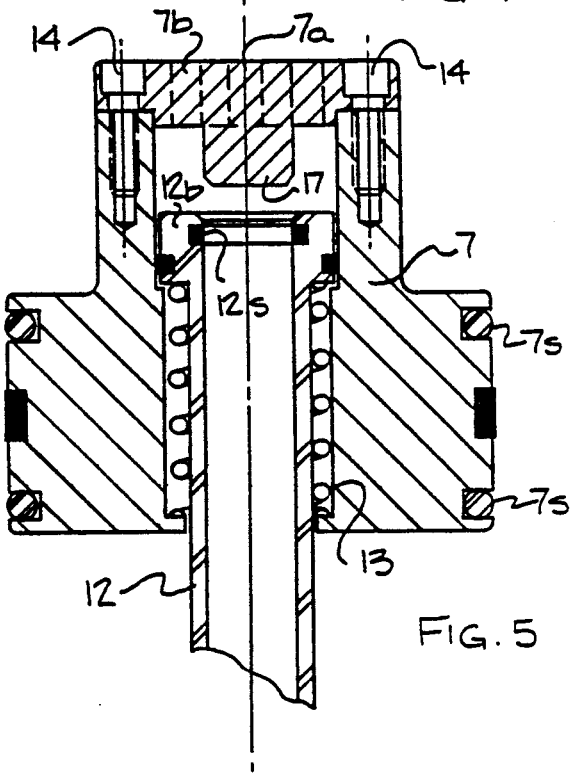
FIG. 5 shows a cross-sectional view of the piston shown in FIG. 4.

Referring now to FIGS. 4 and 5, showing in greater detail the construction of piston 7 and member 12, piston 7 is shown as having a cover plate 7*a* secured to the main body part of piston 7 by means of cap screws 14. The cover plate is provided with a number of perforations 7*b* circularly arranged about a centrally located, downward protruding cylindrical plug 17 which is sized to enter the upper end of member 12 to seal off the communication, normally provided for the oil medium, between the chamber above piston 7 and the interior of member 12. Member 12, as shown best in FIG. 1, is effective, through the contact of its lower flange with the lower side of partition 2 and the upper flange thereof with the shoulder provided in piston 7 and shown clearly in FIG. 5, to limit the movement of piston 7 in an upward direction. A spring 13 is provided to assist in the sealing of the upper end of member 12 which sealing takes place at the initiation of the high pressure portion of the working cycle.

OPERATION OF THE INTENSIFIER CYLINDER

The operation of the cylinder, according to the present invention, will be now described with reference to FIGS. 1,2 and 3. FIG. 1 shows the position of the pistons and other elements at the position of rest or the end of the return stroke of the working cycle. During operation and at this point in the working cycle port 9 is open and primary air pressure is applied to ports 10 and 11, as indicated by the arrows, and to the undersides of pistons 7 and 8. This air pressure is effective to return ram 5 and floating pistons 7 and 8 to their starting positions. Piston 7, in returning to this position, pulls member 12 up with it by virtue of the top flange coupling 12*b* and the cooperating shoulder provided in piston 7. The lower flange 12*a* on member 12 limits the upward movement of piston 7 and simultaneously removes protrusion 17 from the top end of member 12 so that communication is opened between the top side of piston 8 and the lower side of piston 6. Piston 8 continues to move upward and forces the oil medium into the space between pistons 6 and 7 thus forcing piston 6 to return to its uppermost or start position.

Figure 2:
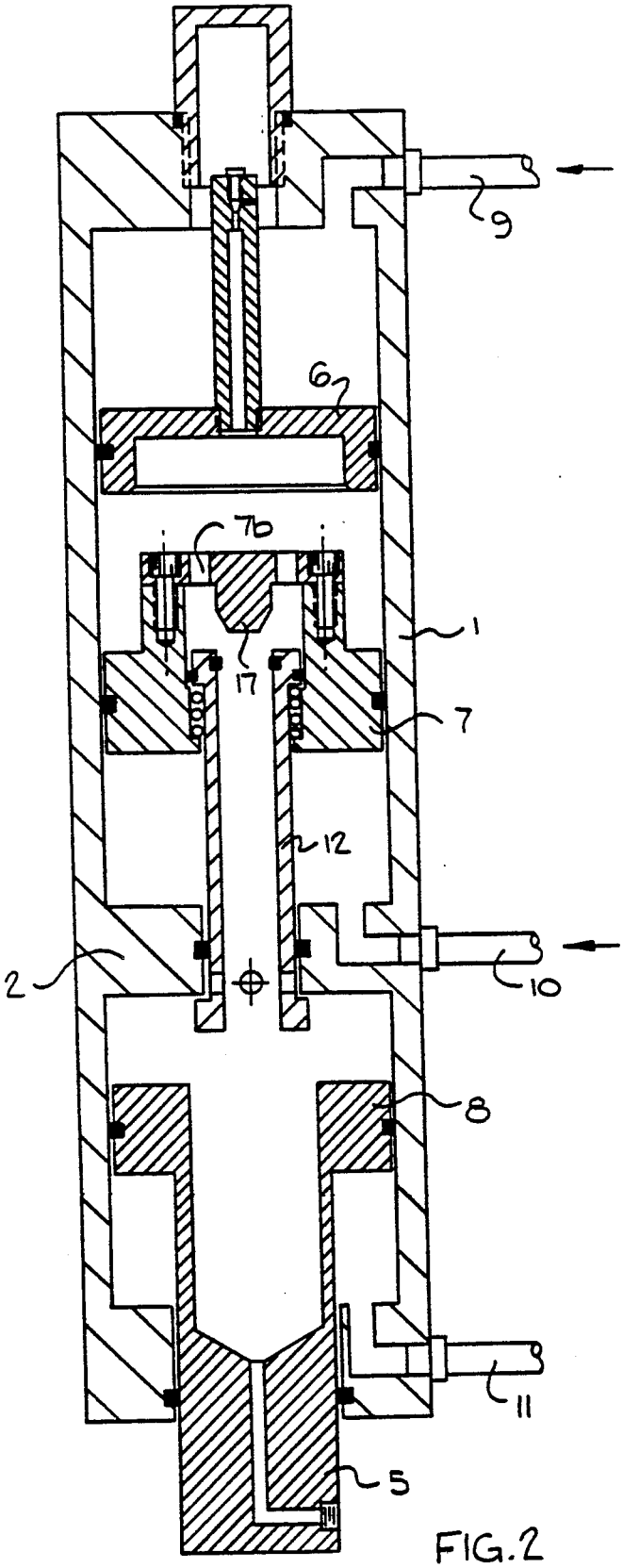
FIG. 2 shows the cylinder of the invention in the initial low pressure portion of a work cycle thereof.

Referring now to FIG. 2, which shows an intermediate point in the working cycle, primary air pressure, as indicated by the arrows, is applied to ports 9 and 10. The pressure applied to piston 6 via port 9 is effective to move that piston downward while the pressure applied to the underside of piston 7 and the friction of the sealing rings 7*s* are sufficient to prevent movement downward of piston 7. The pressure difference across piston 7 is slightly greater in the downward pushing direction due to the thickness of the wall of cylindrical member 12 but is not sufficient to overcome the friction of the sealing rings 7*s*. However the full pressure on the oil medium, provided by piston 6, forces ram piston 8 downward until ram 5 contacts workpiece, not shown.

Figure 3:
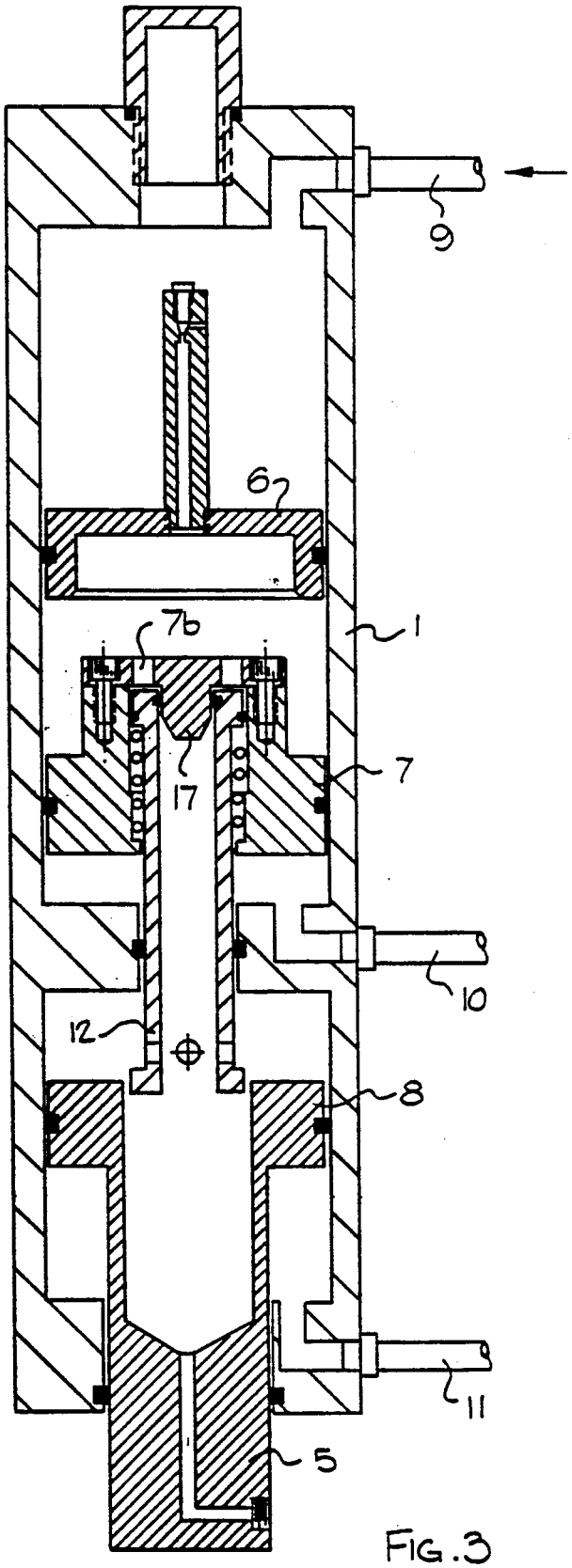
FIG. 3 shows the cylinder of the invention in the final high pressure operating portion of the work cycle.

At this point in the cycle, referring now to FIG. 3, primary pressure is removed from port 10 and the pressure on the oil medium is now effective to move piston 7 downward and, with the assistance of spring 13, to seal the top end of member 12. Spring 13 is preferably present and used to ensure proper sealing of member 12 since there is initially no back pressure on member 12 to assist in the sealing.

At this point in the cycle full primary air pressure is applied to piston 7, via the oil medium between piston 6 and 7, and a step up in the pressure applied to ram piston 8 occurs by virtue of the fact that the full pressure provided by piston 7 is applied to the much smaller area encompassed by member 12, which smaller area, in relationship to the full area of piston 7, when member 12 is sealed off, is designed to be such that a punching or other operation on the workpiece may be performed.

At the termination of the work function of the cylinder ram primary air pressure is applied to ports 10 and 11 to move pistons 7 and 8 upward. The lower shoulder on member 12 now becomes effective to limit the upward movement of that member so that continued movement of piston 7, in the upward direction, removes the sealing protrusion 17 from the upper end of member 12 thus allowing piston 8 to return oil to the space between pistons 6 and 7 and fully return pistons 6 and 8 to their original start positions as shown in FIG. 1. The upward movement of piston 7 continues until spring 13 is compressed. However, spring 13, on its own, is not sufficiently strong as to overcome the friction, provided by the relevant seals, to return the protrusion 17 of piston 7 into the top end of member 12 to produce a seal when primary air pressure is removed from ports 10 and 11.

Due to the fact that member 12 is not mechanically coupled to ram piston 8 that piston can move the full length allowed by the lower part of the housing during the initial part of the working cycle and piston 6 is also free to move with respect to piston 7 with the result that a great variation in thickness of workpieces can be accommodated when sufficient time is allowed in the initial low pressure portion of the working stroke cycle before primary air pressure is removed from port 10 to allow piston 7 to move to seal off the upper end of member 12 and initiate the high pressure portion of the cycle. The time of a complete cycle can be controlled by the timing of the application to and the removal of primary air pressure from ports 9, 10 and 11 as will now be obvious. For instance, the high pressure portion of the working cycle may be initiated by electrical switch means operable when ram 5 contacts a workpiece so that variations in workpiece thickness are automatically taken care of.

It should be noted that the drawings have been simplified to facilitate a clear understanding of a preferred embodiment of the invention and that construction details can be varied and controlled by those skilled in such manufacturing without departing from the spirit and scope of the invention. For instance, the housing may be made in sections to facilitate assembly of a complete working cylinder. In addition it is not essential that the ram piston be coaxial with piston 6 and 7, i.e. the pressure in the lower part of the housing may be piped to a remotely located ram operating cylinder per se. Furthermore, such parts as the flanges for member 12 may be in the form of threaded nuts which are screwed onto the ends of member 12, which ends are provided with the appropriate threading. Further modifications may be made which are considered within the skill of those versed in the relevant art and which do not depart from the spirit and scope of the invention as defined in the appended claims.

I claim:

1. A stepped-fluid-pressure creating arrangement comprising, a closed first floating piston-cylinder unit, means to apply a pressurized primary fluid medium to one side of the floating piston, the other side of the floating piston being contacted by a working fluid medium to be pressurized, a second floating piston-cylinder unit, one side of the piston of the second unit being in fluid medium communication with the working fluid medium to be pressurized, the piston of the second unit being provided with a fluid medium by-pass port, a two part valve means being provided for the port and one part of which is moveable therewith, means to supply pressurized primary fluid medium to the other side of the piston of the second unit whereby the port is maintained open for working fluid medium to pass therethrough and through a conduit member to a working fluid pressure chamber, the conduit member acting as a high pressure creating third piston and as the other part of the valve means and actuated, on closure of the port in the floating piston of the second unit, to move in unison with the piston of the second unit to produce a high pressure on the working fluid medium in the working fluid pressure chamber whereby a high fluid pressure work function may be carried out.

2. The arrangement as claimed in claim 1 wherein the working fluid pressure chamber incorporates an active piston-ram arrangement powered by the working fluid medium.

3. A stepped-fluid-pressure creating cylinder arrangement comprising a cylindrical housing incorporating spaced first and second floating pistons, means to apply a primary fluid pressure medium to one side of the first floating piston, means to provide a working fluid pressure medium in the space between the first and second floating pistons, the second floating piston having a working fluid medium by-pass port therethrough, valve means for closing the by-pass port, the valve means comprising first and second parts one part of which is fixed to move with the second floating piston, the other part of the valve being a hollow cylindrical member movable with respect to the second floating piston between a valve open position and a valve closed position, the cylindrical member passing through a sealed aperture into a closed working fluid pressure chamber and providing a communication path between the working fluid pressure chamber and the space between the first and second floating pistons, the cylindrical member being sealed with respect to the second cylinder to prevent working fluid communication between the working fluid space, between the first and second pistons, and side of the second floating piston remote from the first floatig piston, means to apply primary fluid pressure to the remote side of the second floating piston to maintain the valve means open when primary fluid pressure is applied to the first floating piston, the valve means being closed when primary fluid pressure is removed from the second floating piston and the cylindrical member then being movable in coordination with the second floating piston to act as a pressure creating piston on the fluid medium contained in the fluid pressure chamber and means to utilize the pressurized working fluid medium to perform a work function.

4. The arrangement as claimed in claim 3 wherein the working fluid pressure chamber incorporates a floating piston adapted to perform the work function.

5. The arrangment as claimed in claim 3 or 4 wherein a spring member is provided to assist in closing the valve means when primary fluid pressure is removed from the second floating piston.

6. A stepped-fluid-medium pressure creating cylinder arrangement comprising a closed cylindrical housing provided with first and second axially spaced chambers separated by a partition, axially spaced first and second floating piston located in the first chamber, the second floating piston and the partition being provided with fluid medium by-pass ports, a hollow cylidrical member extending through the aperture in the partition and provided with limited movement with respect thereto and providing a direct fluid medium conduit between the second chamber and the port in the second floating piston whereby there is provided a fluid medium communication between the second chamber and the space between the first and second floating pistons, a two part valve means for closing the port in the second floating piston, one part of the valve means being constituted by the hollow member and the other by a closure member for the hollow member which closure member moves in unison with the second floating piston, the hollow member being sealed into the port of the second floating piston and having biased and limited movement with respect thereto, means to apply a primary fluid pressure to opposed sides of the first and second floating pistons to maintain the valve means open and force fluid medium from between the spaced first and second floating pistons through the hollow member into the second chamber to create a first pressure therein and means to remove said primary fluid pressure from the second floatig piston to initiate closure of the valve means whereby the hollow member moves with the second floating piston, upon continued application of primary fluid pressure to the first floating piston, to act as a piston to create a second and increased pressure in the second chamber of the arrangement, there being means connected with the second chamber to utilize the pressurized fluid medium to perform a work function.

7. The arrangement as claimed in claim 6 wherein the work function is performed by a ram operating piston housed in the second chamber.

8. The arrangement as claimed in claim 7 wherein means is provided to apply a primary fluid medium pressure to the ram and second floating pistons to force medium from the second chamber back into the space between the first and second floating pistons.

* * * * *